US012146500B2

(12) United States Patent
Gross

(10) Patent No.: US 12,146,500 B2
(45) Date of Patent: Nov. 19, 2024

(54) DELIVERY DEVICE FOR DELIVERING A LIQUID

(71) Applicant: Mahle International GmbH, Stuttgart (DE)

(72) Inventor: Martin Gross, Kaempfelbach (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 18/104,780

(22) Filed: Feb. 1, 2023

(65) Prior Publication Data

US 2023/0243363 A1 Aug. 3, 2023

(30) Foreign Application Priority Data

Feb. 2, 2022 (DE) ..... 10 2022 201 108.2

(51) Int. Cl.
*F04D 29/10* (2006.01)
*F04D 1/00* (2006.01)
*F04D 29/046* (2006.01)

(52) U.S. Cl.
CPC ..... *F04D 29/106* (2013.01); *F04D 1/00* (2013.01); *F04D 29/046* (2013.01)

(58) Field of Classification Search
CPC ..... F04D 29/106; F04D 1/00; F04D 29/046; F04D 13/06; F05D 2250/292;
(Continued)

(56) References Cited

U.S. PATENT DOCUMENTS 3,608,910 A * 9/1971 Tyler ..... F16J 15/38 415/174.3
4,172,310 A * 10/1979 Mincuzzi ..... F16J 15/36 415/174.3
(Continued)

FOREIGN PATENT DOCUMENTS

DE 4318158 A1 2/1994
DE 19639930 A1 4/1997
(Continued)

OTHER PUBLICATIONS

Translation of JP-2967373-B2 (Year: 2023).*
(Continued)

*Primary Examiner* — J. Todd Newton
(74) *Attorney, Agent, or Firm* — Fishman Stewart PLLC

(57) ABSTRACT

A delivery device for delivering a liquid may include a housing, a bearing, a shaft seal, a hollow space, and a collection space. A shaft may be arranged in the housing. The shaft may be non-rotatably connected to a delivery mechanism arranged outside the housing. The bearing may be arranged in the housing and may rotatably mount the shaft. The shaft seal may be arranged axially between the bearing and the delivery mechanism and may seal the housing. The shaft seal may be arranged radially outside the shaft. The hollow space may be formed axially between the bearing and the shaft seal. The collection space may be arranged radially on a side of the hollow space facing away from the shaft. The collection space may be fluidically connected to the hollow space via a drain opening. The hollow space may expand radially, axially between the bearing and the shaft seal.

19 Claims, 3 Drawing Sheets

(58) Field of Classification Search
CPC .. F05D 2260/6022; H02K 5/124; H02K 5/04; H02K 5/10
See application file for complete search history.

(56) References Cited

U.S. PATENT DOCUMENTS

| | | | | |
|---|---|---|---|---|
| 4,605,101 | A * | 8/1986 | Barbeau | F01D 25/18 184/6.11 |
| 5,217,350 | A | 6/1993 | Kimura | |
| 5,338,153 | A * | 8/1994 | Swanson | F16J 15/004 415/168.2 |
| 5,836,271 | A | 11/1998 | Sasaki | |
| 6,354,249 | B1 * | 3/2002 | Gerhardt | F04D 29/106 123/25 A |
| 9,719,522 | B2 * | 8/2017 | Yamamoto | F04D 29/128 |
| 10,100,710 | B2 * | 10/2018 | Pates | F04D 13/02 |
| 10,240,617 | B2 | 3/2019 | Russalian | |
| 2012/0134789 | A1 * | 5/2012 | Murakami | F04D 13/02 415/182.1 |
| 2016/0003301 | A1 * | 1/2016 | Schmidt | F16C 33/7853 384/465 |
| 2018/0145219 | A1 | 5/2018 | Kim | |
| 2018/0156219 | A1 * | 6/2018 | Maruyama | F04D 29/708 |
| 2021/0190085 | A1 * | 6/2021 | Hashiguchi | F04D 13/16 |

FOREIGN PATENT DOCUMENTS

| | | | | |
|---|---|---|---|---|
| DE | 102010043264 | A1 | 5/2012 | |
| DE | 102015117126 | A1 | 4/2016 | |
| JP | H07310548 | A | 11/1995 | |
| JP | 2967373 | B2 * | 10/1999 | F04D 29/049 |
| JP | 2020197156 | A | 12/2020 | |

OTHER PUBLICATIONS

English abstract for DE-102010043264.
English abstract for DE-4318158.
English abstract for JP-2020 197 156.
English abstract for JP-H07 31 0548.

* cited by examiner

DELIVERY DEVICE FOR DELIVERING A LIQUID

CROSS-REFERENCE TO RELATED APPLICATIONS

This application claims priority to German Patent Application No. DE 10 2022 201 108.2, filed on Feb. 2, 2022, the contents of which is hereby incorporated by reference in its entirety.

TECHNICAL FIELD

The present invention relates to a delivery device for delivering a liquid, in particular a coolant. The invention additionally relates to a motor vehicle having such a delivery device.

BACKGROUND

A delivery device for delivering a liquid usually comprises a delivery mechanism for delivering the liquid. Usually, the delivery mechanism is non-rotatably connected to a shaft that rotates during the operation, thus driving the delivery mechanism. The shaft is rotatable mounted by means of a bearing which is arranged in a housing of the delivery device. Generally, a shaft seal is arranged between the delivery mechanism and the shaft in order to prevent liquid entering the bearing.

Such delivery devices are known from example from DE 10 2010 043 264 A1, DE 43 181 58 A1, DE 10 2015 117 126 A1, JP 2020 197 156 A, JP H07 31 05 48 A as well as U.S. Pat. No. 10,240,617 B2.

SUMMARY

The present invention deals with the object of stating, for a delivery device of the type mentioned at the outset and for a motor vehicle having such a delivery device, improved or at least other embodiments which eliminate in particular disadvantages from the prior art. In particular, the present invention deals with the object of stating improved or at least other embodiments, which are characterised by an increased lifespan of the delivery device.

According to the invention, this object is solved through the subject matter of the independent claim(s). Advantageous embodiments are the subject matter of the dependent claim(s).

Accordingly, the present invention is based on the general idea of radially expanding a hollow space formed between a bearing and a shaft seal of a delivery device. Thus liquid which during the operation enters the hollow space in particular due to leakage can be stored in a larger quantity/with a larger volume before the liquid flows out of the hollow space. This results in that no liquid reaches the bearing or that the corresponding risk is at least reduced. From this results a prevention or at least reduction of damage due to an aging processes of the bearing caused by the liquid or a liquid vapour coming into contact with the bearing, so that the lifespan of the delivery device is increased. Here, the knowledge that the lifespan of the delivery device depends, substantially or at least to a greater extent, on the lifespan of the bearing is utilized here, so that a reduction of the damage to and the aging processes of the bearing results in a correspondingly increased lifespan of the delivery device. Further, the knowledge that liquid, despite the shaft seal, can enter the hollow space due to movements that occur during the operation, vibrations, accelerations and particles contained in the liquid, can enter the hollow space is utilized, so that the expanded hollow space better protects the bearing against the liquid also in such constellations, by way of which the lifespan is increased also for that reason.

According to the inventive idea, the delivery device comprises a housing in which a shaft is arranged. The bearing is arranged in the housing and rotatably mounts the shaft about an axial rotation axis. During the operation, the shaft thus rotates about the rotation axis and is non-rotatably connected to a delivery device that is arranged outside the housing, so that the delivery device delivers the liquid during the operation. The shaft seal is arranged axially between the bearing and the delivery mechanism as well as radially outside of the shaft and serves for sealing the hollow space from liquid entering the hollow space. The hollow space is formed axially between the bearing and the shaft seal. Further, the delivery device comprises a collection space, which is arranged on the side of the hollow space radially facing away from the shaft. The collection space is fluidically connected to the hollow space via an opening. This radially expands the hollow space axially between the bearing and the shaft seal.

The directions stated here refer to the rotation axis of the shaft, which runs axially. Accordingly, "axially" runs parallel, in particular coaxially to the rotation axis. Further, "radially" runs transversely to the rotation axis. In addition, the circumferential direction runs surrounding the rotation axis.

Consequently, the hollow space is radially expanded towards the outside along the rotation axis and thus axially. Preferably, the hollow space is expanded at least in portions, preferentially entirely, continuously radially to the outside.

The radial expansion of the hollow space must be understood in particular in comparison with a known cylindrical hollow space known from the prior art.

Separately from the hollow space, the collection space serves for collecting liquid entering the hollow space. Thus, the liquid flows via the opening into the collection space. In the following, the opening is also referred to as drain opening.

The drain opening practically opens into the hollow space and into the collection space.

Generally, the collection space can be arranged/formed outside the housing.

Advantageously, the collection space is formed in the housing. This results in a simplified and compact design of the delivery device.

The delivery device can be employed for delivering any liquid.

In particular, the delivery device is employed in an associated application for delivering a liquid coolant. During the operation of the associated application, the delivery device delivers liquid along a flow path. Since contact of the coolant with the bearing results in a pronounced damage to/or aging of the bearing, an advantageous protection of the bearing is achieved by the delivery device according to the invention in the case of a coolant as liquid.

The delivery device can be employed for example in a motor vehicle.

The delivery device can be incorporated in particular in a circuit, through which the liquid circulates during the operation, wherein the delivery device during the operation delivers the liquid through the circuit and thus along the flow path.

In the associated application, in particular in the motor vehicle, the circuit can serve for temperature-controlling, i.e. cooling and/or heating.

It is conceivable in particular to employ the circuit for air-conditioning an interior, in particular of the motor vehicle, and thus as part of an air-conditioning system.

To axially position the bearing in the housing, the delivery device, in particular the housing, can comprise a projection, projecting radially to the inside. The projection can thus enter the hollow space radially.

Generally, the axial positioning of the bearing can take place in that the bearing axially butts up against the projection.

In preferred embodiments, a seal for sealing the bearing against the hollow space is arranged axially between the bearing and the projection, which in the following is also referred to as bearing seal. This results in a further improved protection of the bearing and thus in a further increased lifespan.

Advantageously, the bearing seal is arranged radially outside the shaft. Preferably, the bearing seal slides on the shaft during the operation. Thus, the sealing of the bearing against the hollow space is improved.

Advantageously, the bearing seal is arranged axially between the projection and the bearing. In particular, the bearing seal can be axially positioned in the housing by means of the projection. It is conceivable in particular that the bearing seal is axially loaded mechanically by the bearing and/or the projection.

Generally, the delivery mechanism can be in any configuration, provided the non-rotatable connection to the shaft results in the delivery of the liquid during the operation. It is to be understood that the non-rotatable connection can be disconnectable, for example by means of a clutch, for example in order to drive the delivery mechanism by means of the shaft merely when required and/or merely in one direction of rotation of the shaft.

In particular, the delivery mechanism is a pump mechanism. The delivery device is thus designed in particular as a pump. It is conceivable that the delivery mechanism comprises an impeller which is non-rotatably connected to the shaft.

Advantageously, the shaft projects axially out of the housing through an axially open aperture of the housing and is non-rotatably connected to the delivery mechanism. In the follow, the aperture is also referred to as shaft aperture. Preferably, the shaft seal is arranged in the shaft aperture. This leads to an improved sealing of the hollow space against the entry of liquid.

Basically, the shaft seal can be of any design.

Advantageously, the shaft seal is formed as a sliding ring seal. This results in an improved sealing of the hollow space. Preferably, the shaft seal slides on the shaft during the operation. Thus, a further improved sealing of the hollow space is achieved.

Preferred are embodiments, in which the drain opening in the associated application is arranged at a radially lowermost point of the hollow space. Thus, the liquid can reliably and more easily flow into the collection space via the drain opening in particular due to the force of gravity. When using the delivery device in a motor vehicle, the drain opening is consequently arranged along a Z-direction of the motor vehicle at the lowermost point or in the vertical direction at the lowermost point of the hollow space.

Preferably, the delivery device comprises a further opening spaced apart in the circumferential direction from the drain opening for discharging gases and vapours out of the hollow space, which opening is fluidically connected to the environment. Thus, the opening serves in particular for venting the hollow space. In addition, the opening serves for discharging evaporating liquid out of the hollow space, i.e. of liquid vapour. In the following, the opening is also referred to as ventilation opening. This results in that the liquid also flows out of the hollow space as vapour and thus further improves the protection of the bearing and further increases the lifespan.

Advantageously, the ventilation opening is situated in a radially upper region of the hollow space. As a consequence, gases and/or vapour can more easily flow out of the hollow space via the ventilation opening.

Preferred are embodiments, in which the ventilation opening is arranged at a radially uppermost point of the hollow space. In particular, the ventilation opening is arranged radially opposite the drain opening. This results in an improved flow of gases and/or vapour out of the hollow space via the ventilation opening. When using the delivery device in a motor vehicle, the ventilation opening is arranged along the Z-direction of the motor vehicle at the uppermost point of the hollow space or in vertical direction at the uppermost point of the hollow space.

Basically, the drain opening and/or the ventilation opening can be of any design. In particular, the drain opening and/or the ventilation opening can be formed as a bore. Here it is preferable when the drain opening and/or the ventilation opening extend/s radially.

Advantageously, the drain opening comprises a cross-section that can be flowed through of at least 6 mm, preferably of at least 7 mm. Thus, liquid can also reliably flow into the collection space when, with increasing service life, deposits form in the drain opening.

Advantageously, the ventilation opening comprises a cross-section that can be flowed through of at least 6 mm, preferably of at least 7 mm. Thus, gases and liquid vapour can reliably flow out of the hollow space even when, with increasing service life, deposits form in the ventilation opening.

In preferred embodiments, the hollow space expands radially, axially towards the shaft seal. Thus, there is a flow of the liquid towards the shaft seal and consequently away from the bearing. This increases the protection of the bearing and results in a further increased lifespan.

In preferred embodiments, the hollow space expands radially towards the drain opening. Thus, the liquid in the hollow space can flow better to the drain opening and as a consequence better out of the hollow space. The result is a better protection of the bearing and thus an increased lifespan.

Preferred are embodiments, in which the hollow space expands radially up to the drain opening. Thus, the drain opening is arranged at the radially lowermost point of the hollow space, wherein at the same time the expansion of the hollow space results in a flow of the liquid leading towards the drain opening. As a consequence, the liquid can flow better and more easily out of the hollow space. Consequently, the bearing is protected better and the lifespan increased further.

Embodiments, in which the hollow space expands radially from the projection as far as to the drain opening, are considered advantageous. Thus, the available space between the bearing and the drain opening is substantially employed for expanding the hollow space. Consequently, the hollow space is further expanded so that the hollow space can store more liquid. As a result, the bearing is protected better and the lifespan increased.

Advantageous are embodiments, in which the hollow space is radially expanded in the direction of the ventilation opening. As a consequence, a further expansion of the hollow space is achieved, wherein at the same time gases and/or vapour can flow better along the hollow space in the direction of the ventilation opening and thus out of the hollow space. The result is a better protection of the bearing and thus an increased lifespan.

In preferred embodiments, the hollow space expands radially as far as to the ventilation opening. Consequently, the ventilation opening forms a radially outermost point, particularly preferably the radially uppermost point of the hollow space. As a result, both the hollow space is expanded and also a flow of gases and/or vapour out of the hollow space via the ventilation opening improved. Thus, the bearing is protected better and thus the lifespan further increased.

An advantageous variant is obtained in that the hollow space expands radially from the projection as far as to the ventilation opening. As a consequence, the available space between the bearing and the ventilation opening is substantially utilized for radially expanding the hollow space. Thus, a further expansion of the hollow space is achieved so that the hollow space can store more liquid and/or gases or vapours. As a result, the bearing is protected better and the lifespan further increased.

Basically, the hollow space can radially expand differently towards the drain opening and towards the ventilation opening.

Advantageously, the hollow space expands radially equally towards the drain opening and towards the ventilation opening. Thus, a simplified production of the delivery device is achieved. Preferably, the hollow space is formed symmetrically with respect to a plane containing the rotation axis. The plane runs axially and radially, preferably in the circumferential direction in the middle between the drain opening and the ventilation opening. Thus, the hollow space is advantageously shaped in the manner of a bathtub. Besides an expanded volume of the hollow space, a simplified production of the delivery device is achieved in this way.

With respect to rotations about the rotation axis, the hollow space can basically be formed asymmetrically or N-times symmetrically, wherein N is a natural number greater than or equal to 1. Advantageously excluded are the drain opening and/or ventilation opening, which are preferably formed locally in the circumferential direction.

Preferably, the hollow space is entirely formed rotation-symmetrically. Thus, the hollow space can be shaped in the manner of a straight cone. Thus, a further expansion of the hollow space is achieved, so that the hollow space can store more liquid and/or gases or vapour. As a consequence, an improved protection of the bearing and thus an increased lifespan are achieved.

It is to be understood that besides the delivery device a motor vehicle having such a delivery device is also part of the scope of this invention.

Further important features and advantages of the invention are obtained from the sub-claims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

It shows, in each case schematically

DETAILED DESCRIPTION

Figure 1:
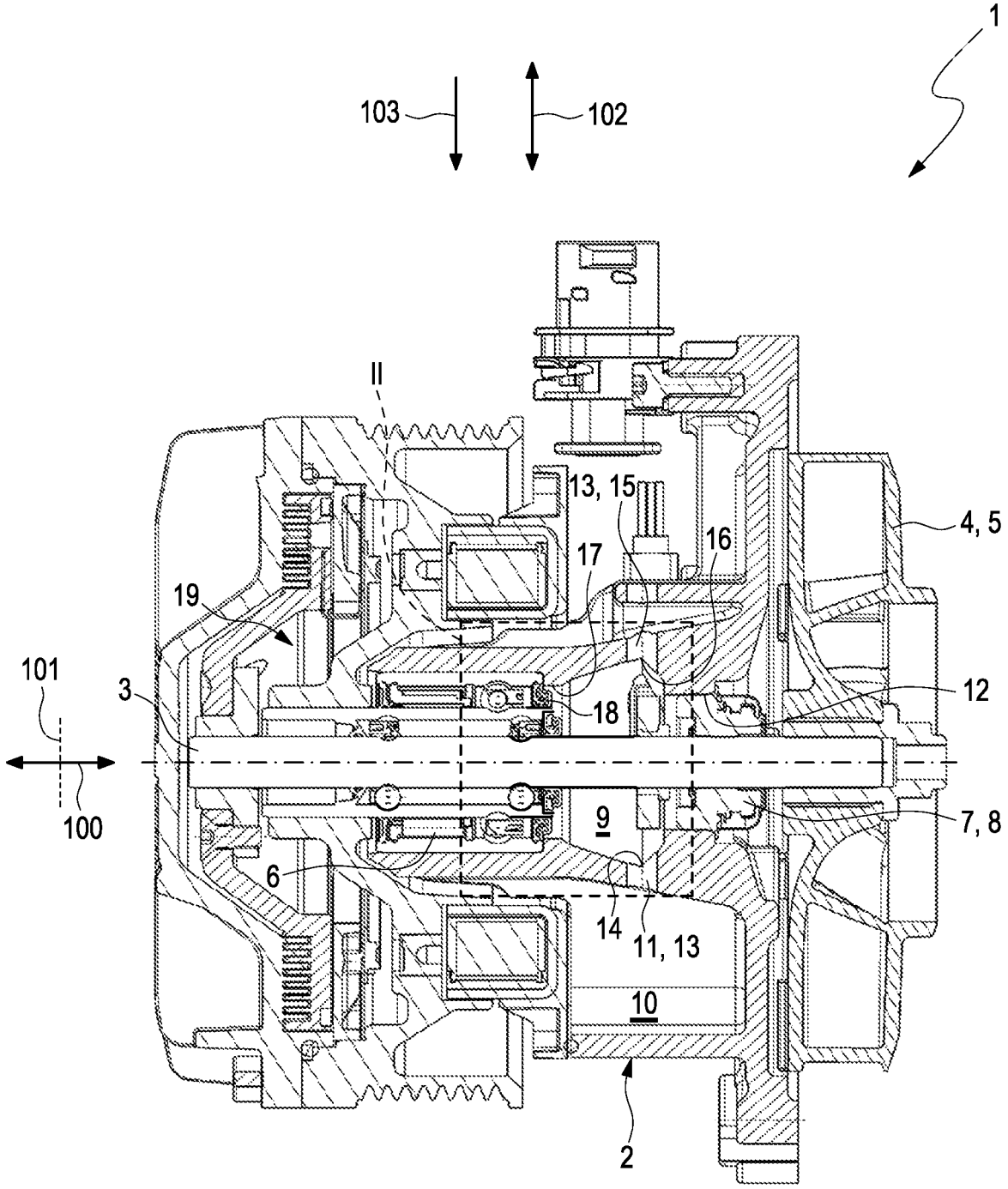
FIG. 1 shows a section through a delivery device.
Figure 2:
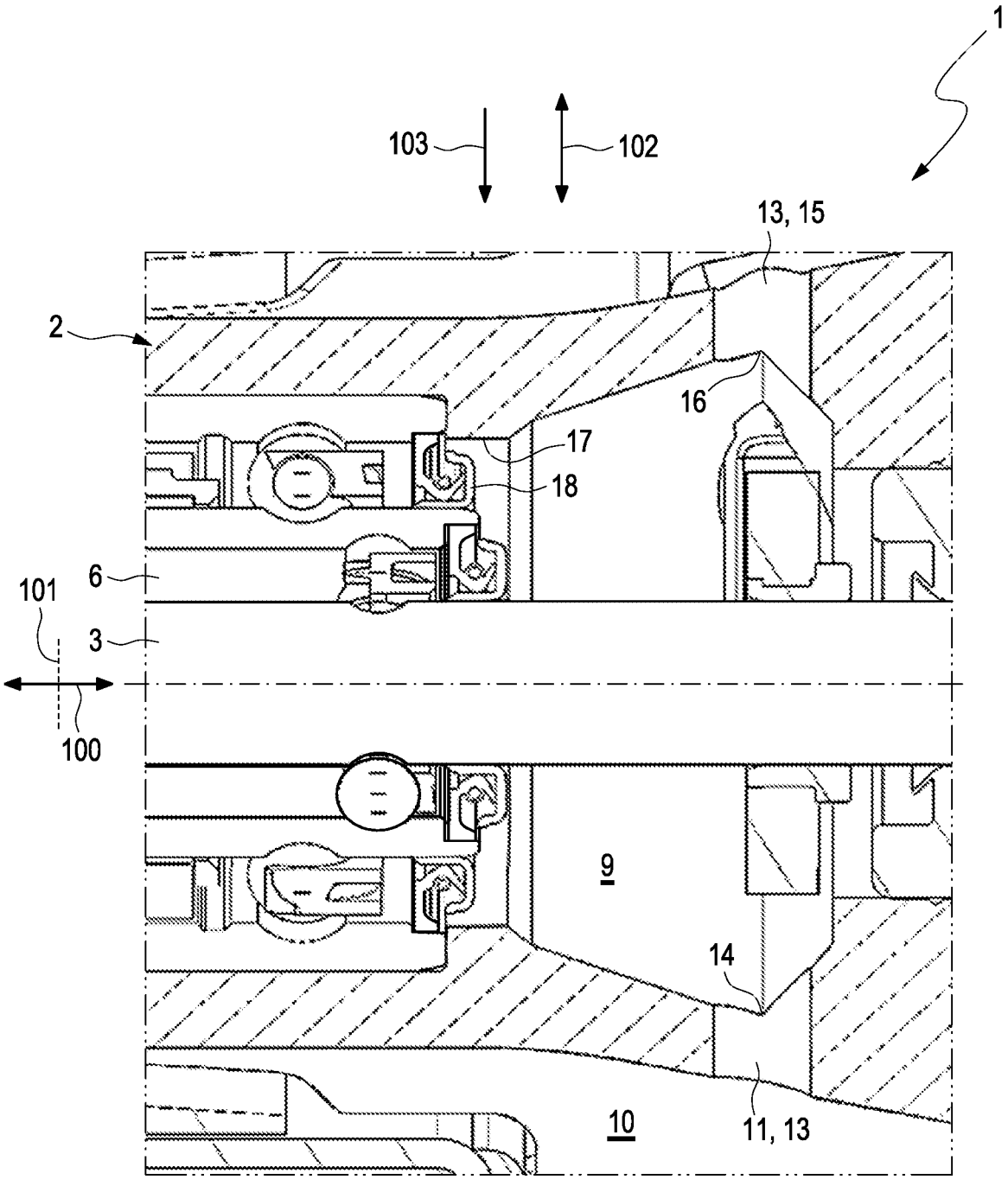
FIG. 2 shows an expanded view of the portion designated II in FIG. 1.
Figure 3:
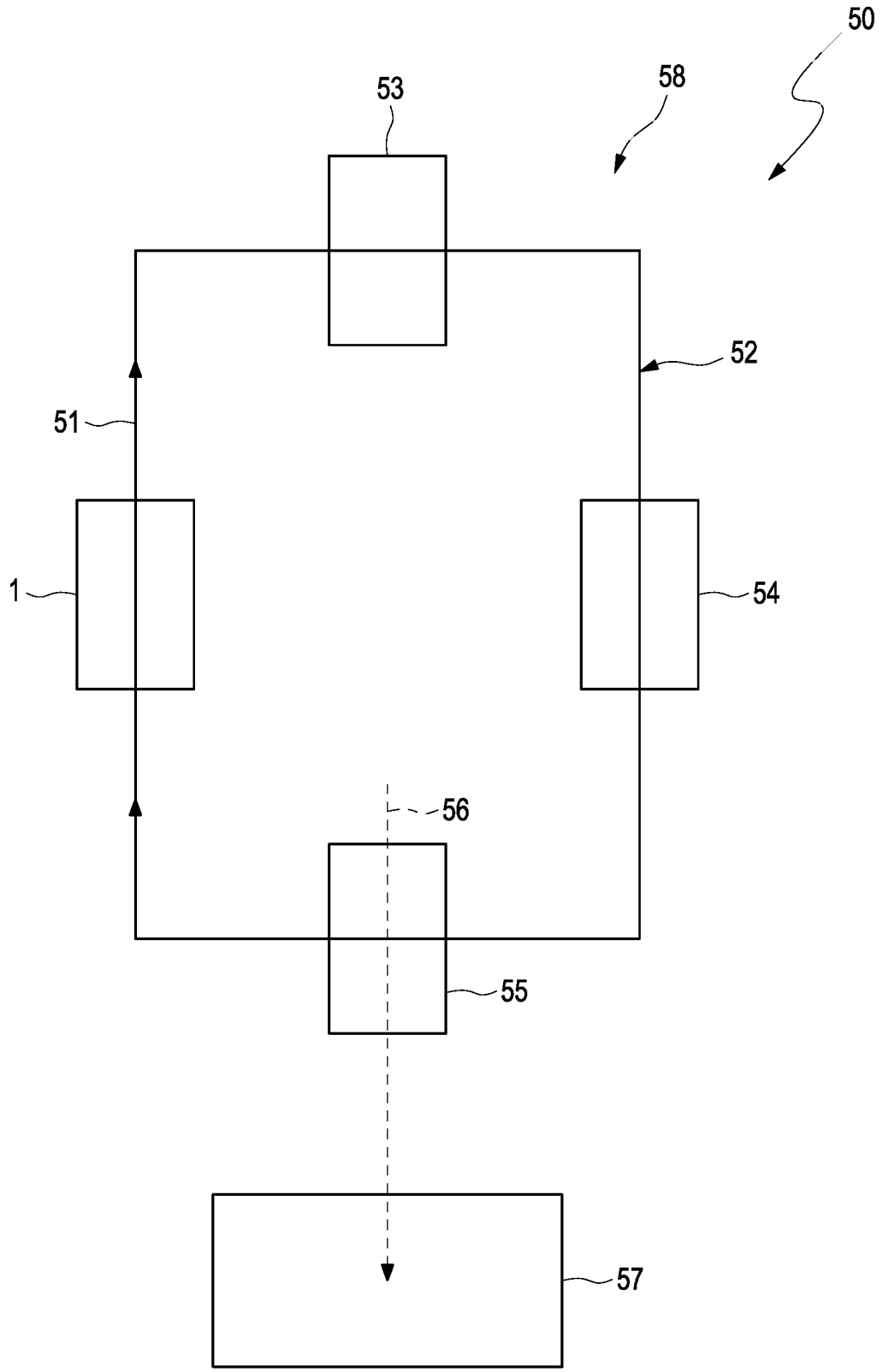
FIG. 3 shows a greatly simplified representation in the manner of a circuit diagram of a motor vehicle having a delivery device.

A delivery device 1, as is exemplarily shown in the FIGS. 1 to 3, is employed for delivering a liquid, in particular of coolant. As is shown in a simplified manner in FIG. 3, the delivery device 1 can be employed in a motor vehicle 50 in order to deliver liquid, in particular coolant, in the motor vehicle 50 along a flow path 51.

FIG. 1 shows an axial section through the delivery device 1 and FIG. 2 an expanded representation of the portion designated II in FIG. 1.

As is evident from FIGS. 1 and 2, the delivery device 1 comprises a housing 2. The shaft 3 rotates about an axial rotation axis 100 during the operation. For this purpose, the shaft 3, in the shown exemplary embodiment, is driven by an electric motor 19, which in the shown exemplary embodiment is arranged in the housing 2. The shaft 3 is non-rotatably connected to a delivery mechanism 4 arranged outside the housing 2, so that the delivery mechanism 4 delivers the liquid during the operation. In the exemplary embodiment shown in the FIGS. 1 and 2, the delivery mechanism 4 is designed as an impeller 5. In addition, the shaft 3 axially projects through an aperture 12 of the housing 2, which in the following is also referred to as the shaft aperture 12, and is non-rotatably connected to the delivery mechanism 4. In the housing 2, the delivery device 1 comprises a bearing 6 which rotatably mounts the shaft 3 about the rotation axis 100. A shaft seal 7 for sealing the housing 2 against entry of liquid is arranged axially between the bearing 6 and the delivery mechanism 4. The shaft seal 7, in the exemplary embodiment shown in the FIGS. 1 and 2, is formed as a sliding ring seal 8, which slides on the shaft 3 during the operation. In addition, the shaft seal 7 is arranged in the shaft aperture 12. Axially between the bearing 6 and the shaft seal 7 a hollow space 9 is formed, through which the shaft 3 extends axially. On the side of the hollow space 9 radially facing away from the shaft 3, a further hollow space 10 is formed in the housing, which in the following is also referred to as collection space 10. The collection space 10 is fluidically connected to the hollow space 9 via an opening 11. During the operation of the delivery device 1, liquid can enter the hollow space 10 despite the shaft seal 7, in particular because of the design of the shaft seal 7, because of movements, because of aging processes and because of particles in the liquid. This liquid can flow into the collection space 10 via the opening 11. In the following, the opening 11 is also referred to as drain opening 11. The drain opening 11 opens into the hollow space 9 and into the collection space 10 and is formed as a bore 13 which extends radially in the shown exemplary embodiment. As is further evident from the FIGS. 1 and 2, the hollow space 9 expands radially, axially between the bearing 6 and the shaft seal 7.

The directions stated here each refer to the axial rotation axis 100. Accordingly, "axially" runs parallel, in particular coaxially, to the rotation axis 100. In addition, "radially" runs transversely to the rotation axis 100. Further, the circumferential direction 101 runs surrounding the rotation axis 100.

The hollow space 9 radially expanding axially between the bearing 6 and the shaft seal 7 thus expands radially to the outside along the rotation axis 100 and thus axially. In the shown exemplary embodiment and preferably, this expansion runs continuously. Thus, compared for example with a cylindrical shape, the hollow space 9 has an expanded volume. The expanded volume of the hollow space 9 results in that liquid can be buffer-stored with an increased amount in the hollow space 9 in order to subsequently flow via the drain opening 11 into the collection space 10. Thus, it is prevented that the liquid reaches the bearing 6 and damages the bearing 6 or at least reduces the probability of such damage. Accordingly, the lifespan of the delivery device 1 is increased.

As is evident from the FIGS. 1 and 2, the delivery device 1, in the shown exemplary embodiment, comprises an opening 15 spaced apart in the circumferential direction 101 from the drain opening 10, which connects the hollow space 9 with the environment. As explained above, the drain opening 11 serves for the flowing and thus draining of the liquid out of the hollow space 9 into the collection space 10. The drain opening 11 in the hollow space 9 is arranged on a radially outermost point 14 of the hollow space 9. The point 14 in the associated application, i.e. for example in the motor vehicle 50, forms the radially lowermost point 14 of the hollow space 9. This means that the radially outermost point 14 along a Z-direction 102 of the motor vehicle 50 or in the vertical direction 103 forms the lowermost point 14 of the hollow space 9. Thus, the liquid can flow better from the hollow space 9 into the collection space 11. The opening 15 serves for discharging gases out of the hollow space 9 and thus for the ventilating and the discharging of liquid vapour, and is also referred to as ventilation opening 15 in the following. In the shown exemplary embodiment, the ventilation opening 15 is arranged radially opposite the drain opening 11 and likewise formed as a bore 13, which extends radially. Accordingly, the ventilation opening 15 is arranged at a radially uppermost point 16 of the hollow space 9.

As is evident from the FIGS. 1 and 2, the hollow space 9, in the shown exemplary embodiment, expands radially, axially towards the shaft seal 7. This means that the hollow space 9 expands radially in the direction of the shaft seal 7. In addition, the hollow space 9 expands radially towards the drain opening 11. In the shown exemplary embodiment, the hollow space 9, further, expands radially towards the ventilation opening 15. Thus, the hollow space 9 is further expanded, wherein at the same time both liquid and also gas, in particular liquid vapour, can flow more easily and better out of the hollow space 9.

In the shown exemplary embodiment, the housing 2 comprises a projection 17 projecting radially to the inside, which axially positions the bearing 6 in the housing 2. The projection 17 is axially arranged between the shaft seal 7 and the bearing 6 and runs closed in the circumferential direction 101. The hollow space in the shown exemplary embodiment 9 expands radially from the projection 17 as far as to the drain opening 11 and from the projection 17 as far as to the ventilation opening 15. As is evident from the FIGS. 1 and 2, the hollow space 9 is formed symmetrically with respect to a plane containing the rotation axis 100 and projecting transversely out of the drawing plane. Thus, the hollow space 9 in the portion shown in the FIGS. 1 and 2 is shaped in the manner of a bathtub. The hollow space 9 is preferably formed rotation-symmetrically with respect to the rotation axis 100 (not shown), i.e. is advantageously shaped in the manner of a straight cone. Excluded from this are the drain opening 11 and the ventilation opening 15, each of which extend locally in the circumferential direction 101.

As is evident in particular from FIG. 2, the delivery device 1, shown in the exemplary embodiment, comprises a seal 18 axially between the bearing 6 and the shaft seal 7 and axially adjoining the bearing 6, which seals the bearing 6 against the hollow space 9 and in the following is also referred to as bearing seal 18. The bearing seal 18 is arranged axially between the projection 17 and the bearing 6 and axially positioned between the bearing 6 and the projection 17. The bearing seal 18 is arranged radially outside of the shaft 3 and slides on the shaft 3 during operation. Thus, a better protection of the bearing 6 and consequently an increased lifespan of the delivery device 1 are achieved.

According to FIG. 3, the motor vehicle 50 can comprise a circuit 52 for the liquid, through which the flow path 51 leads, so that the liquid circulates through the circuit 52 during the operation. The delivery device 1 is incorporated in circuit 52 in such a manner that it delivers the liquid through the circuit 52 during the operation. In the shown exemplary embodiment, the liquid is coolant, so that the circuit 52 is a coolant circuit 52. In the shown exemplary embodiments, the circuit 52, beside the delivery device 1, comprises further components, for example a condenser 53 arranged downstream of the delivery device 1 for condensing the coolant, an expander 54 arranged downstream of the condenser 53 for expanding the coolant and an evaporator 55 arranged downstream of the expander 54 and upstream of the delivery device 1 for evaporating the coolant. An air flow 56, as indicated in FIG. 3 by a dashed arrow, can flow, fluidically separated from the coolant, through the evaporator 55 and into an interior 57 of the motor vehicle 50, in order to cool the interior 57. The circuit 52 can thus be part of an air-conditioning system 58.

The invention claimed is:

1. A delivery device for delivering a liquid, comprising:

a housing in which a shaft is arranged, the shaft, during operation, rotating about an axial rotation axis;

the shaft non-rotatably connected to a delivery mechanism arranged outside the housing such that the delivery mechanism delivers the liquid during operation;

a bearing arranged in the housing and rotatably mounting the shaft about the rotation axis;

a shaft seal arranged axially between the bearing and the delivery mechanism for sealing the housing against entry of liquid, the shaft seal arranged radially outside the shaft;

a hollow space formed axially between the bearing and the shaft seal;

a collection space arranged radially on a side of the hollow space facing away from the shaft, the collection space fluidically connected to the hollow space via a drain opening;

wherein the hollow space expands radially outward relative to the rotation axis, axially between the bearing and the shaft seal, and wherein the hollow space expands radially, axially towards the shaft seal.

2. The delivery device according to claim 1, wherein the hollow space expands radially towards the drain opening.

3. The delivery device according to claim 2, wherein:
the housing includes a projection projecting radially to an inside and axially positioning the bearing; and
the hollow space expands radially from the projection to the drain opening.

4. The delivery device according to claim 1, wherein:
a ventilation opening is disposed spaced apart from the drain opening in a circumferential direction of the shaft and connects the hollow space with an environment for ventilation; and
the hollow space expands radially, axially towards the ventilation opening.

5. The delivery device according to claim 4, wherein:
the housing includes a projection projecting radially to an inside and axially positioning the bearing; and
the hollow space expands radially from the projection to the ventilation opening.

6. The delivery device according to claim 4, wherein:
the drain opening is arranged at a radially lowermost point of the hollow space; and
the ventilation opening is arranged at a radially uppermost point of the hollow space.

7. The delivery device according to claim 1, further comprising a bearing seal, wherein, axially between the bearing and the shaft seal and axially adjoining the bearing, the bearing seal seals the bearing against the hollow space.

8. The delivery device according to claim 1, wherein:
the shaft axially projects through a shaft aperture of the housing and is non-rotatably connected to the delivery mechanism; and
the shaft seal is arranged in the shaft aperture.

9. A motor vehicle, comprising:
a flow path of a liquid extending through the motor vehicle; and
a delivery device according to claim 1;
wherein the delivery device is arranged in the flow path and, during operation, delivers the liquid along the flow path.

10. The motor vehicle according to claim 9, further comprising a circuit for the liquid, wherein the flow path extends through the circuit such that the liquid circulates through the circuit during operation.

11. A delivery device for delivering a liquid, comprising:
a housing including:
a shaft aperture configured to receive a shaft non-rotatably connected to a delivery mechanism arranged outside of the housing;
a hollow space;
a collection space; and
a drain opening extending between and fluidically connecting the hollow space and the collection space;
a bearing arranged in the housing, the bearing configured to rotatably mount the shaft within the housing;
a shaft seal configured to engage the shaft, the shaft seal arranged axially between the bearing and the outside of the housing relative to a longitudinal axis of the shaft aperture;
wherein the hollow space is disposed (i) axially between the bearing and the shaft seal and (ii) radially between the collection space and the longitudinal axis of the shaft aperture; and
wherein, as the hollow space extends axially toward the shaft seal, the hollow space expands radially outward.

12. The delivery device according to claim 11, wherein the drain opening is arranged at a lowermost point of the hollow space such that liquid is flowable through the drain opening from the hollow space to the collection space via gravity.

13. The delivery device according to claim 11, wherein:
the housing further includes a projection projecting radially inward toward the longitudinal axis of the shaft aperture and axially positioning the bearing; and
the projection is disposed axially spaced apart from the drain opening.

14. A delivery device for delivering a liquid, comprising:
a housing including:
a shaft aperture configured to receive a shaft non-rotatably connected to a delivery mechanism arranged outside of the housing;
a hollow space;
a collection space; and
a drain opening extending between and fluidically connecting the hollow space and the collection space;
a bearing arranged in the housing, the bearing configured to rotatably mount the shaft within the housing;
a shaft seal configured to engage the shaft, the shaft seal arranged axially between the bearing and the outside of the housing relative to a longitudinal axis of the shaft aperture;
wherein the hollow space is at least partially disposed (i) axially between the bearing and the shaft seal and (ii) radially between the collection space and the longitudinal axis of the shaft aperture; and
wherein an outer radial dimension of the hollow space increases as the hollow space extends axially toward the drain opening.

15. The delivery device according to claim 1, wherein, axially between the bearing and the shaft seal, at least a portion of the hollow space has a truncated cone shape.

16. The delivery device according to claim 1, wherein:
a first portion of the hollow space disposed axially between the drain opening and the bearing has a truncated cone shape;
a second portion of the hollow space disposed axially between the drain opening and the shaft seal has a truncated cone shape; and
the truncated cone shape of the first portion of the hollow space and the truncated cone shape of the second portion of the hollow space are oriented in opposite directions.

17. The delivery device according to claim 1, wherein the hollow space is at least partially defined by a surface of the housing extending obliquely relative to the rotation axis of the shaft.

18. The delivery device according to claim 1, wherein:
the housing further includes a projection projecting radially inward toward the rotation axis of the shaft;
the hollow space is at least partially defined by at least one surface of the housing extending obliquely relative to the rotation axis of the shaft; and
the at least one surface of the housing is disposed axially between the projection and the drain opening.

19. The delivery device according to claim 18, wherein:
the at least one surface of the housing includes a first oblique surface and a second oblique surface;
the first oblique surface extends from the drain opening to the second oblique surface;
the second oblique surface extends from the first oblique surface to a surface of the projection extending parallel to the rotation axis; and the first oblique surface and the second oblique surface extend transversely relative to one another.

* * * * *